US005398218A

United States Patent [19]

Munnier et al.

[11] Patent Number: 5,398,218

[45] Date of Patent: Mar. 14, 1995

[54] CONNECTION OF A BAND TO A WATCH CASE

[75] Inventors: Louis Munnier, Damprichard, France; Hidekichi Ichikawa, Tokorozawa, Japan

[73] Assignee: Citizen Watch Co., Ltd., Tokyo, Japan

[21] Appl. No.: 297,841

[22] Filed: Aug. 30, 1994

[30] Foreign Application Priority Data

Aug. 31, 1993 [JP] Japan ..... 5-051974 U

[51] Int. Cl.[6] ..... G04B 37/16; A44C 5/14

[52] U.S. Cl. ..... 368/282; 224/164; 224/177

[58] Field of Search ..... 368/281, 282; 224/164, 224/167, 168, 171, 177, 180

[56] References Cited

U.S. PATENT DOCUMENTS

| | | | |
|---|---|---|---|
| 4,935,910 | 6/1990 | Akasaka et al. | 368/382 |
| 5,119,351 | 6/1992 | Gogniat | 368/282 |

FOREIGN PATENT DOCUMENTS

| | | | |
|---|---|---|---|
| 400206 | 12/1990 | European Pat. Off. . | |
| 38604 | 5/1907 | Switzerland | 368/282 |
| 661416 | 7/1987 | Switzerland . | |
| 662019 | 11/1951 | United Kingdom | 368/282 |
| 2127673 | 4/1984 | United Kingdom | 224/164 |
| 2198028 | 6/1988 | United Kingdom | 224/164 |

*Primary Examiner*—Bernard Roskoski

*Attorney, Agent, or Firm*—Dennison, Meserole, Pollack & Scheiner

[57] ABSTRACT

A pair of band connecting lugs are formed on opposite sides of the watch case. Each lug has a groove formed on the underside of the lug in the lateral direction with respect to the band, an opening of the groove having a smaller width than a width of the groove. A band has a pair of cylindrical portions forming a recess therebetween. A connecting pin comprising a solid pin and a hollow pin slidably mounted on the solid pin is engaged with the cylindrical potions of the band. The solid pin has a small diameter portion which is able to pass the opening of the groove. Each of the solid pin and the hollow pin has a large diameter portion which is engageable with the groove and is unable to pass the opening.

3 Claims, 5 Drawing Sheets

CONNECTION OF A BAND TO A WATCH CASE

BACKGROUND OF THE INVENTION

The present invention relates to a connection of a band to a watch case.

FIGS. 6 and 7 show a conventional connection of a band to a watch case. A watch case 31 has a pair of band connecting lugs 32 formed to be projected at band connecting sides, and a guide groove 34 formed on the surface thereof, having a semicircular shape. Each of the band connecting lugs 32 has a lateral groove 33 formed thereon, extending in the lateral direction of the band. A connecting pin 41 connected to a band 40 is engaged with the lateral groove 33. A bezel 35 is pivotally mounted on the watch case 31. The bezel 35 has a lug 39 corresponding to the connecting lug 32 of the watch case, a pipe 36 secured to the underside thereof to be slidably engaged with the guide groove 34 of the watch case, and a ball 37 mounted in the pipe 36 and urged by a spring 38.

In order to connect the band 40 to the watch case 31, the bezel 35 is rotated along the guide groove 34 so as to expose the lateral groove 33 of the connecting lug 32. During the rotation, the ball 37 in the pipe 36 is rotated in the guide groove 34 so that the bezel 35 can be rotated, keeping the engagement with the watch case 31. The pin 41 connected to the band 40 is engaged with the lateral groove 33 of the connecting lug 32. Thereafter, the bezel 35 is returned to the original position to hide the connecting lug 32.

In such a connection, since it is not necessary to disengage the connecting pin 41 from the band 40, the band is easily changeable without using a special tool.

However, in manufacturing the watch, it is necessary to form a guide groove 34 on the watch case 31 by cutting process and to secure the pipe 36 to the bezel 35. Therefore, the watch is complicated in structure, which causes manufacturing cost to increase.

SUMMARY OF THE INVENTION

An object of the present invention is to provide a connection of a band to a watch case which is simple in structure and may be made at a low cost.

Another object of the present invention is to provide a connection in which the band is easily changeable without removing a connecting pin from the band and without special technique and a tool.

According to the present invention, there is provided a connection of a band to a watch case comprising a pair of band connecting lugs formed on opposite sides of the watch case, each of the lugs having a groove formed on the underside of the lug in the lateral direction with respect to the band, an opening of the groove having a smaller width than a width of the groove, the band having a bifurcated connecting end comprising a pair of cylindrical portions forming a recess there-between so as to be engaged with the lug of the watch case, a connecting pin engaged in the cylindrical portions of the band.

The connecting pin comprises a solid pin and a hollow pin slidably mounted on the solid pin. The solid pin has a small diameter portion which is able to pass the opening of the groove, and each of the solid pin and the hollow pin has a large diameter portion which is engageable with the groove and is unable to pass the opening.

These and other objects and features of the present invention will become more apparent from the following detailed description with reference to the accompanying drawings.

DETAILED DESCRIPTION OF THE PREFERRED EMBODIMENT

Figure 1:
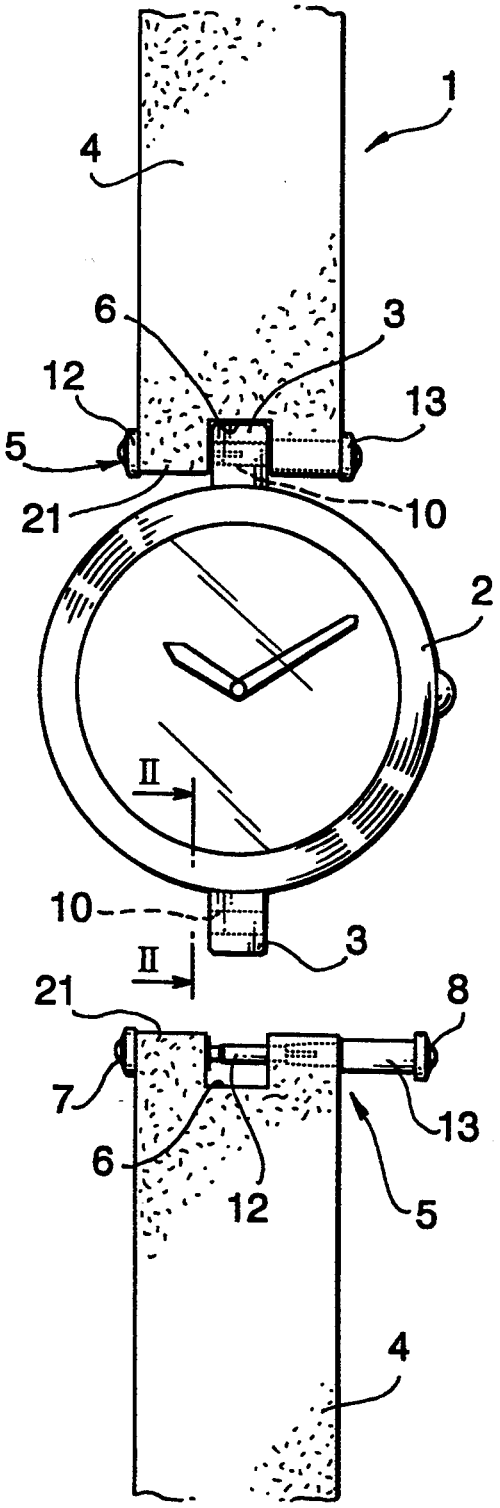
FIG. 1 is a plan view showing a watch case and a band according to the present invention.

Referring to FIG. 1 showing a wrist watch to which the present invention is applied, a watch case 2 of a watch 1 comprises a pair of band connecting lugs 3 formed on opposite sides of the watch case at band connecting portions thereof, and a set of bands 4 connected to the respective connecting lugs 3.

Figure 2:
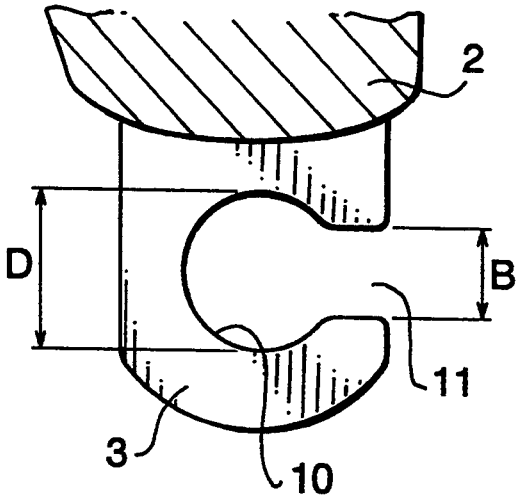
FIG. 2 is an enlarged sectional view showing a connecting lug taken along a line II—II of FIG. 1.

Referring to FIG. 2, the connecting lug 3 is provided with a groove 10 formed on the underside thereof in the lateral direction with respect to the band 4 and having an opening 11. The groove 10 has a circular shape in section and an inner diameter D. The opening 11 has a width B which is smaller than the diameter D of the groove 10.

Each band 4 has a bifurcated connecting end comprising a pair of rounded cylindrical portions 21 and a recess 6 formed between the cylindrical portions 21. A connecting pin 5 is engaged with the holes in the cylindrical portions 21. The width of the recess 6 is larger than the width of the connecting lug 3 of the watch case 2 to be engaged with the connecting lug 3.

Figure 3:
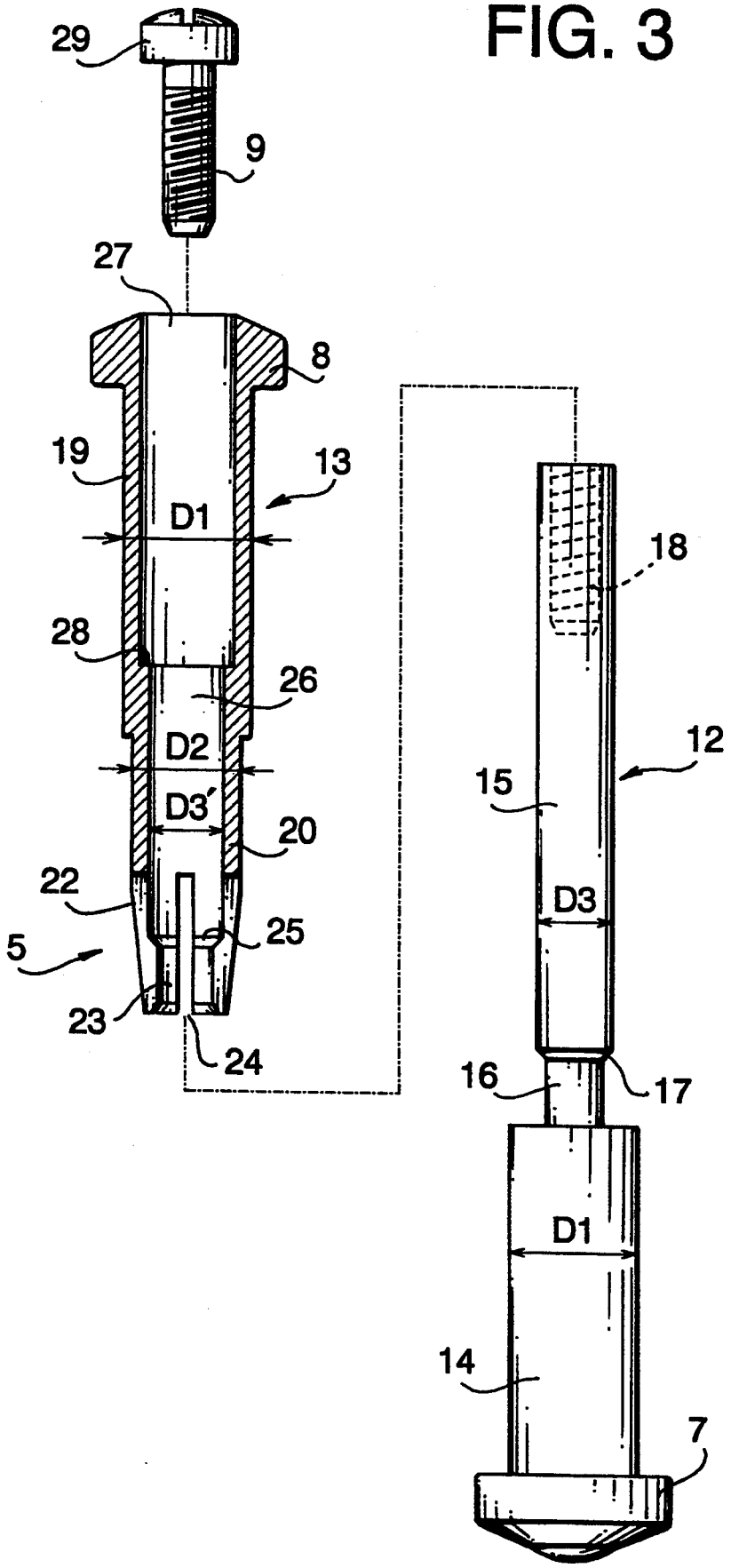
FIG. 3 is an exploded sectional plan view of a connecting pin.

Referring to FIG. 3, the connecting pin 5 comprises a solid first pin 12 and a hollow second pin 13 to be slidably mounted on the first pin 12.

The first pin 12 comprises a head portion 7, a large diameter portion 14, a small diameter portion 15, and a joint portion 16 formed between the large and small diameter portions 14 and 15. The joint portion 16 has the diameter smaller than that of the small diameter portion 15. Thus, a tapered shoulder portion 17 is formed between the small diameter portion 15 and the joint portion 16. A threaded hole 18 is formed in an end of the small diameter portion 15 to be engaged with a screw 9.

The outer diameter D1 of the large diameter portion 14 is slightly larger than the inner diameter D of the groove 10 of the connecting lug 3. The outer diameter D3 of the small diameter portion 15 is slightly smaller than the width B of .the opening 11, and the length thereof is slightly longer than the width of the recess 6 of the band 4.

The hollow second pin 13 has a length slightly longer than the sum of the length of the small diameter portion 15 and the length of the joint portion 16 of the first pin 12, and an axial hole formed therein, passing through the pin. The second pin 13 comprises a head portion 8, a large diameter portion 19, a small diameter portion 20, and an end portion 22. The large diameter portion 19 has the outer diameter D1 which is the same as that of the large diameter portion 14 of the first pin 12. The small diameter portion 20 has the outer diameter D2 which is larger than the width B of the opening 11 and smaller than the diameter D of the groove 10.

In the second pin 13, an axial hole 27 is formed passing through the head portion 8 and the large diameter portion 19. An axial hole 26 is formed to be communicated with the hole 27 and passing through a part of the large diameter portion 19 and the small diameter portion 20. The hole 26 has an inner diameter D3' which is smaller than the diameter of the hole 27, so that a shoulder portion 28 is formed on the inner wall of the pin 13 between the holes 27 and 26. The diameter D3' is slightly larger than that of the small diameter portion 15 of the first pin 12 so as to be slidably mounted on the small diameter potion 15. The end portion 22 has an axial hole 23 communicated with the hole 26, a plurality of axial slits 24, and a tapered outer wall. The inner diameter of the hole 23 is smaller than the diameter D3'. Thus, a tapered shoulder portion 25 is formed on the inner wall between the holes 26 and 23, corresponding to the tapered shoulder portion 17 of the first pin 12. The diameter of the hole 23 is substantially the same as the outer diameter of the joint portion 16 of the first pin 12, so as to be engaged therewith.

A screw head 29 of the screw 9 has a diameter smaller than the inner diameter of the hole 27 and larger than the diameter D3' of the hole 26.

Figure 4:
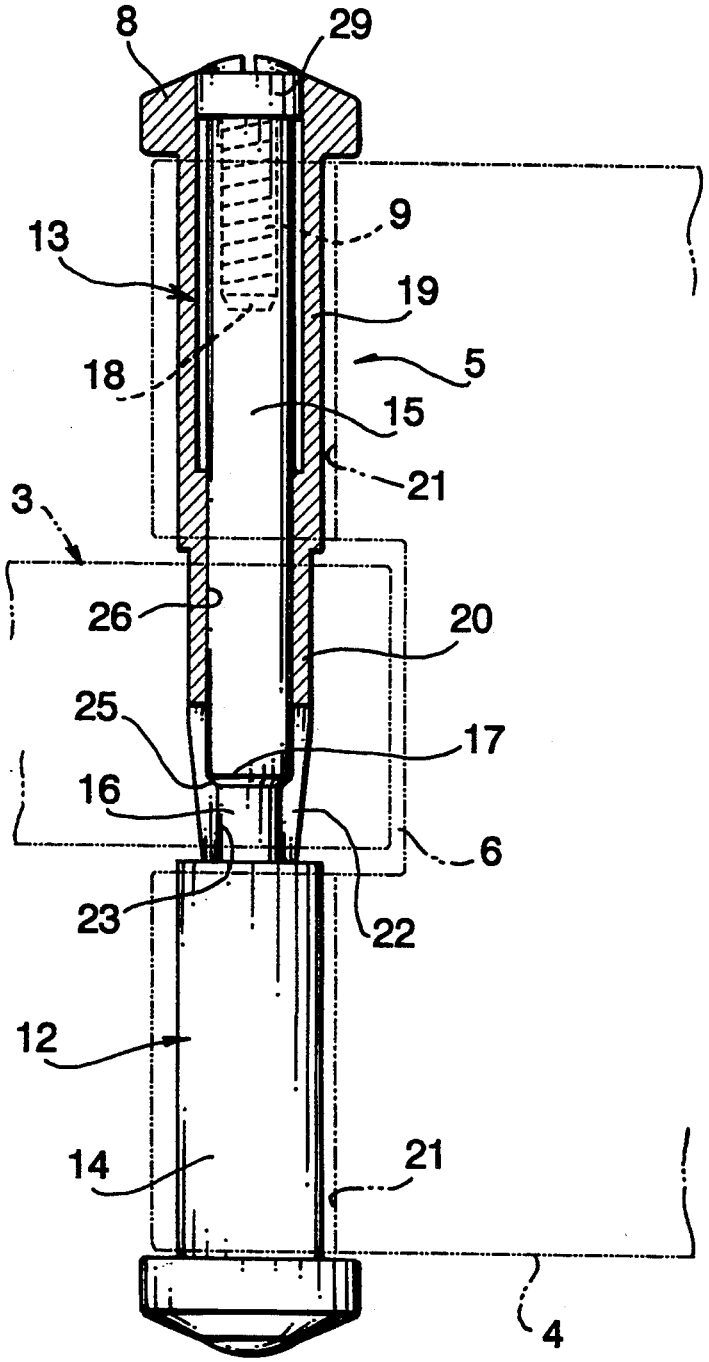
FIG. 4 is a sectional plan view of the connecting pin in an engaging state.
Figure 5:
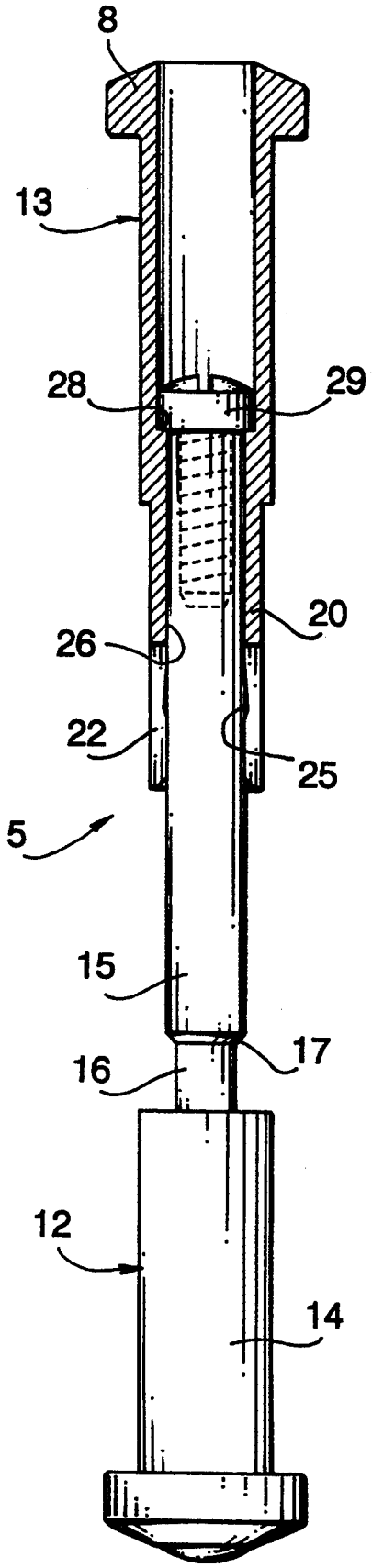
FIG. 5 is a sectional plan view of the connecting pin in a stretched state.
Figure 6:
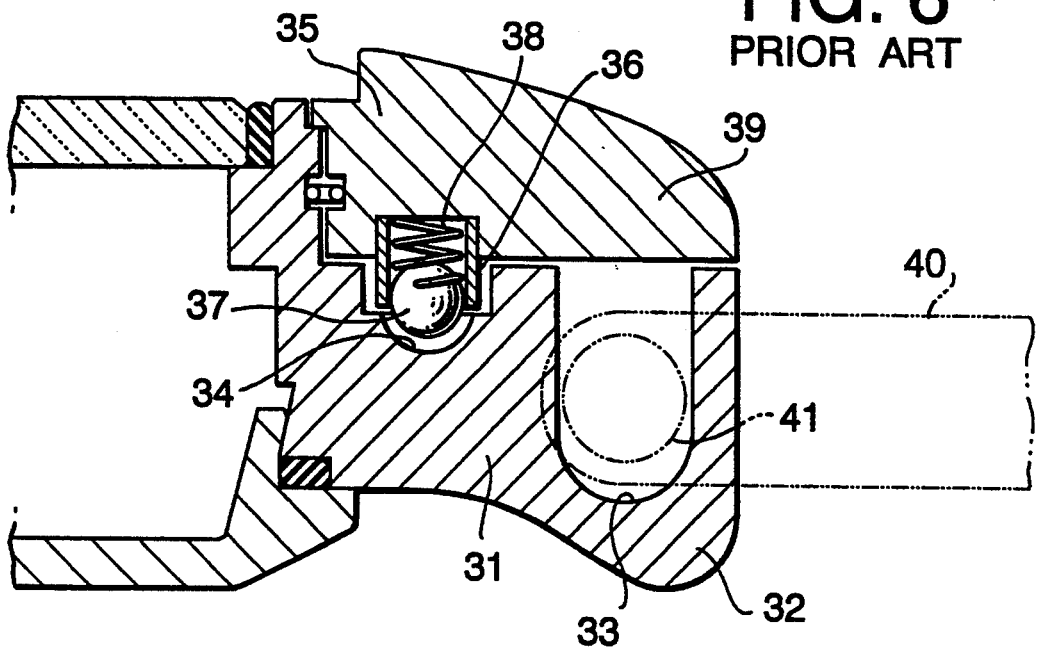
FIG. 6 PRIOR ART
FIG. 6 is a sectional view of a conventional watch case.
Figure 7:
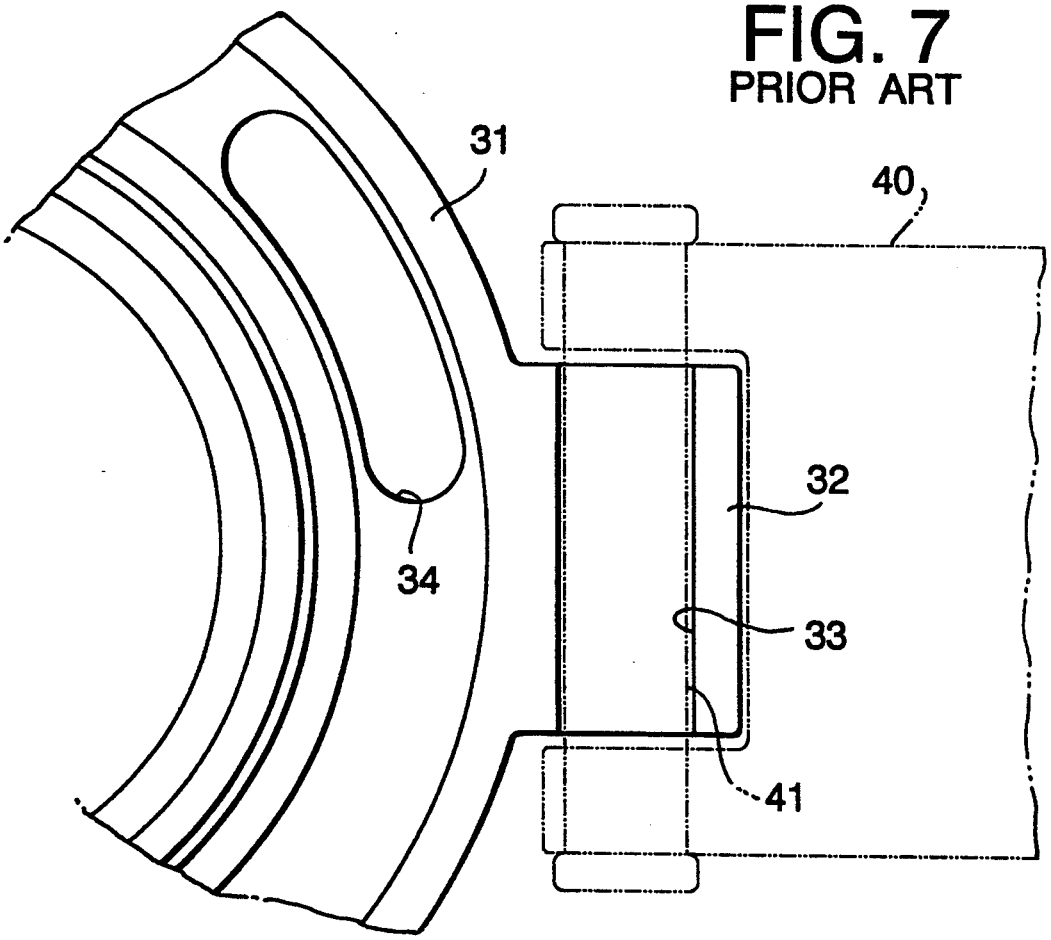
FIG. 7 PRIOR ART
FIG. 7 is a plan view showing a part of the watch case.

The assembling of the first and second pins 12 and 13 to form the connecting pin 5 will be described with reference to FIGS. 4 and 5.

The first and second pins 12 and 13 are inserted into each of the rounded cylindrical portions 21 of the band 4 at opposite sides thereof. The inner diameter of each rounded cylindrical portion 21 is larger than the outer diameter D1 of the large diameter portion of the pin and smaller than the diameters of the head portions 7 and 8 of the pin. Both of the head portions 7 and 8 are pushed inwardly. The small diameter portion 15 of the first pin 12 is inserted into the axial hole 23 of the end portion 22 of the second pin 13. Since the small diameter portion 15 has the diameter D3 which is larger than the inner diameter of the hole 23, the end portion 22 is expanded with the aid of the slits 24. Thus, the small diameter portion 15 can be inserted into the hole 26 and further into the hole 27. When the joint portion 16 is inserted into the end portion 22, the end portion 22 shrinks and engages with the joint portion 16, while the shoulder portion 17 is engaged with the shoulder portion 25. Thus, the first pin 12 is positioned and fixed to the second pin 13.

In the contract state, the end of the first pin 12 reaches the inside of the head portion 8 of the second pin 13, and the head portions 7 and 8 are projected from the rounded cylindrical portions 21 of the band 4. The screw 9 is engaged with the threaded hole 18 of the small diameter portion 15. As shown in FIG. 4, the large diameter portions 14 and 19 of the pins 12 and 13 are engaged with the rounded cylindrical portions 21, and the small diameter portion 20 of the second pin 13 is exposed from the recess 6.

In order to connect the band 4 to the watch case 2 through the pin 5, the projected head portions 7 and 8 are pulled outwardly in the opposite directions. As shown in FIG. 5, the joint portion 16 and the shoulder portion 17 of the first pin 12 are disengaged from the end portion 22 and the shoulder portion 25 of the second pin 13, respectively. The small diameter portion 15 of the first pin 12 is revealed out of the second pin 13. When the head 29 of the screw 9 engages with the shoulder portion 28 in the second pin 13, stretching of the pin assembly is stopped. Thus, the first pin 12 is not completely separated from the second pin 13.

The small diameter portion 15 is positioned to the connecting lug 3 at the underside, inserted in the opening 11, and engaged in the groove 10. Then, the head portions 7 and 8 are pushed inwardly to insert the small diameter portion 15 into the second pin 13. When the joint portion 16 engages with the end portion 22, the small diameter portion 20 of the pin 13 is engaged with the groove 10 of the connecting lug 3. As hereinbefore described, since the outer diameter D2 of the small diameter portion 20 is larger than the width B of the opening 11, the pin 5 is prevented from removing from the connecting lug 3. Consequently, the band 4 is firmly fixed to the watch case 2 through the connecting pin 5.

The band can be disconnected from the watch case in the reverse operation.

In accordance with the present invention, the connecting lug of the watch case has a groove and an opening which are different in inside width. The telescopically engaged connecting pins have different diameters corresponding to the groove and the opening.

Thus, the connecting pin connected to the band is easily engaged with and disengaged from the connecting lug, and prevented from removing from the connecting lug in an engaging state.

The bezel and guide groove in the conventional connection is not provided in the watch of the present invention, and only the groove is formed on the connecting lug in a simple manufacturing process.

The band is easily changeable without special technique and tool.

While the invention has been described in conjunction with preferred specific embodiment thereof, it will be understood that this description is intended to illustrate and not limit the scope of the invention, which is defined by the following claims.

What is claimed is

1. A connection of a band to a watch case comprising:

a pair of band connecting lugs formed on opposite sides of the watch case, each of the lugs having a groove formed on the underside of the lug in the lateral direction with respect to the band, an opening of the groove having a smaller width than a width of the groove;

the band having a bifurcated connecting end comprising a pair of cylindrical portions forming a recess there-between so as to be engaged with the lug of the watch case;

a connecting pin engaged in the cylindrical portions of the band;

the connecting pin comprising a solid pin and a hollow pin slidably mounted on the solid pin, the solid pin having a small diameter portion which is able to pass the opening of the groove, and each of the solid pin and the hollow pin having a large diameter portion which is engageable with the groove and is unable to pass the opening.

2. The connection of the band to the watch case according to claim 1 wherein the solid pin and the hollow pin have joining portions which are engaged with each other in a contract state.

3. The connection of the band to the watch case according to claim 1 wherein the solid pin and the hollow pin have stopper portions for preventing both pins from disengaging from each other.

* * * * *